United States Patent [19]

Basile et al.

[11] Patent Number: 5,005,226

[45] Date of Patent: Apr. 9, 1991

[54] FLUSHING MECHANISM WITH LOW WATER CONSUMPTION

[75] Inventors: Peter A. Basile, Lawrenceville; Ashvani K. Madan, Ocean; Fred E. Snyder, Princeton Junction, all of N.J.; Harold M. Stillman, Scarsdale, N.Y.

[73] Assignee: American Standard Inc., New York, N.Y.

[21] Appl. No.: 522,010

[22] Filed: May 11, 1990

Related U.S. Application Data

[62] Division of Ser. No. 440,363, Nov. 30, 1989.

[51] Int. Cl.[5] ..... E03D 3/10

[52] U.S. Cl. ..... 4/354

[58] Field of Search ..... 4/354–364

[56] References Cited

U.S. PATENT DOCUMENTS

| | | | |
|---|---|---|---|
| 2,286,896 | 6/1942 | Carrillo . | |
| 2,629,878 | 3/1953 | Dewitt . | |
| 2,918,680 | 12/1959 | Langdon . | |
| 2,957,181 | 10/1960 | Lamping . | |
| 3,149,344 | 9/1964 | Langdon . | |
| 3,378,855 | 4/1968 | Springer . | |
| 3,553,739 | 1/1971 | Owens . | |
| 3,555,571 | 1/1971 | Gibbs et al. | 4/362 |
| 3,605,125 | 9/1971 | Gibbs et al. . | |
| 3,628,195 | 12/1971 | Skousgaard . | |
| 3,677,294 | 7/1972 | Gibbs et al. . | |
| 3,792,497 | 2/1974 | Robbins . | |
| 3,813,701 | 6/1974 | Stevens . | |
| 3,817,279 | 6/1974 | Larson . | |
| 3,817,286 | 6/1974 | Caron et al. . | |
| 3,817,489 | 6/1974 | Caron et al. . | |
| 3,820,171 | 6/1974 | Larson . | |
| 3,820,754 | 6/1974 | Caron et al. . | |
| 3,890,651 | 6/1975 | Wood . | |
| 4,060,857 | 12/1977 | Couton | 4/362 |
| 4,115,883 | 9/1978 | Dauvergne . | |
| 4,142,262 | 3/1979 | Hamilton . | |
| 4,143,433 | 3/1979 | Skousgaard . | |
| 4,183,108 | 1/1980 | Hamilton . | |
| 4,232,409 | 11/1980 | Van Pham | 4/362 |
| 4,233,698 | 11/1980 | Martin . | |
| 4,310,934 | 1/1982 | Hennessy et al. . | |
| 4,707,868 | 11/1987 | Hennessy . | |

*Primary Examiner*—Charles E. Phillips

*Attorney, Agent, or Firm*—Blum Kaplan

[57] ABSTRACT

A flushing mechanism for flushing a toilet bowl with a reduced amount of water. The flushing mechanism includes a containment vessel adapted to fit in a standard-sized toilet tank and means within the containment vessel for forcing water out of the vessel into the bowl to be flushed. In a first embodiment, the containment vessel includes an elastic bladder which is filled with the liquid and expands to provide the additional pressure. In a second embodiment, a piston spring system forces liquid out of the containment vessel to flush the bowl. A hydraulic actuation system is also provided for actuating the flushing mechanisms.

14 Claims, 9 Drawing Sheets

30
32
3
3
54
24
24a
95
26
60
62
64
106
107
25
109
44a
44
56
104
108
103
2
2
20
24a
24
62
26
25
23
22

FLUSHING MECHANISM WITH LOW WATER CONSUMPTION

This a division of application Ser. No. 07/440,363, filed on Nov. 30, 1898.

BACKGROUND OF THE INVENTION

The present invention is generally directed to a flushing mechanism and, in particular, to a flushing mechanism adapted for use in toilet flushing applications which uses less water during each flushing cycle than in conventional toilet flushing mechanisms.

Conventional flushing mechanisms used in toilet flushing operations generally use one of two different approaches to remove waste material from the toilet bowl. In a firs approach, siphoning action is utilized to create a vacuum which draws bowl water and waste into the drain line and refills the bowl with fresh water. In a second approach which is typically used in household applications, a tank on the toilet bowl holds a predetermined amount of water which, when released, generates a high velocity flow which carries bowl water and waste into the drain line and refills the bowl with fresh water. The second approach relies on the weight of the water due to gravity to flush and replenish the bowl.

Since the weight of the water alone is utilized to flush and replenish the bowl, conventional toilets using this conventional system require about 14 to 16 liters during each flushing operation. Because of the concern for water conservation in general and the ever increasing passage of legislation requiring reduced water consumption in toilet flushing operations, it has become imperative that appropriate flushing mechanisms be developed and implemented to insure reduced water consumption during such toilet flushing operations However, it is also important that such new flushing devices be adaptable for use in existing tank-type toilets.

An attempt has been made to reduce water consumption by increasing the pressure provided by the water in the toilet tank. One such system is shown in U.S. Pat. Nos. 3,677,294 and 3,817,279. The systems disclosed in these patents utilize a pressure storage vessel, initially containing air at atmospheric pressure, which is filled with water at an elevated pressure thereby compressing the air in the tank. During the flush cycle, the air expands rapidly, exerting an additional force on the stored water thereby driving the stored water through the bowl at high velocity. Through the use of a such a system, less water is generally required during each flushing operation.

Systems such as those described in the above-cited U.S. patents have proven less than completely satisfactory for two reasons. First, since the internal volume of the pressure storage vessel must be sufficient to contain both the water required for the flush and compressed air, the vessel must be oversized, thereby requiring a larger water tank than is found on conventional toilets. Second, since the potential energy of the stored water is a function of inlet water line pressure, flushing performance will decrease at pressures substantially below the design pressure of the system.

The present inventors have developed several new flushing mechanisms and hydraulic actuation therefor which overcome the disadvantages inherent in the prior art. Accordingly, it is desired to provide improved flush systems adapted for toilet flushing operations which use substantially less water than used by conventional systems.

SUMMARY OF THE INVENTION

Generally speaking, in accordance with the present invention, a flushing mechanism for flushing a bowl with liquid is provided. The flushing mechanism includes a containment vessel and an actuation system designed to replace standard flushing components in a conventional toilet tank.

In a first embodiment, the containment vessel is adapted to hold a predetermined amount of liquid and adapted to fit in a standard size toilet tank. In toilet flushing applications, the predetermined amount of liquid should be on the order of about 6 liters. The containment vessel includes an inlet for receiving the liquid under a predetermined pressure such as supply line water pressure. The containment vessel also includes an outlet coupleable to the bowl for permitting liquid in the containment vessel to be released into the bowl. A piston under the operation of a biasing mechanism such as a spring is displaceable in the containment vessel and forces the liquid out of the containment vessel under the force exerted by the spring when the outlet is opened. The biasing mechanism is isolated from any liquid in the vessel. A sealing device is also provided for releasably sealing the outlet. The sealing device is controlled by an actuation system which releases the sealing device to open the outlet to permit liquid in the containment vessel to be forced out of the containment vessel and into the bowl under the force of the piston and spring construction.

In a second embodiment, the containment vessel includes an elastic bladder supported therein which holds a predetermined amount of the liquid to be used for flushing. The liquid is introduced through an inlet into the bladder to expand the bladder to essentially fill the containment vessel. An outlet on the containment vessel is coupleable to the bowl and open to the elastic bladder to permit release of the liquid in the elastic bladder into the bowl. A sealing device releasably seals the outlet and an actuation system is provided for selectively actuating the sealing device to open the outlet to release liquid in the elastic bladder into the bowl under the force exerted by the elastic bladder.

In order to insure appropriate actuation of the flushing mechanism, an improved hydraulic actuation system is disclosed which insures that the sealing device opens and closes in proper timing and operation. The hydraulic actuation system also acts as a pressure sensing system which leaves the flush valve open until flushing is complete to conserve water.

Accordingly, it is an object of the present invention to provide an improved flushing mechanism.

Another object of the present invention is to provide an improved flushing mechanism for flushing a toilet bowl with reduced water consumption.

A further object of the present invention is to provide a flushing mechanism for flushing a toilet bowl with reduced water consumption which fits in a conventional toilet tank.

Yet another object of the present invention is to provide an improved flushing mechanism for flushing a toilet bowl where additional force is provided to the flushing water by means of a spring piston operation.

A still further object of the present invention is to provide an improved flushing mechanism for flushing a toilet bowl with increased water pressure utilizing the force exerted by an elastic bladder.

An even further object of the present invention is to provide an improved hydraulic actuation system for actuating the flushing mechanisms of the present invention.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figures 1, 2, 7:
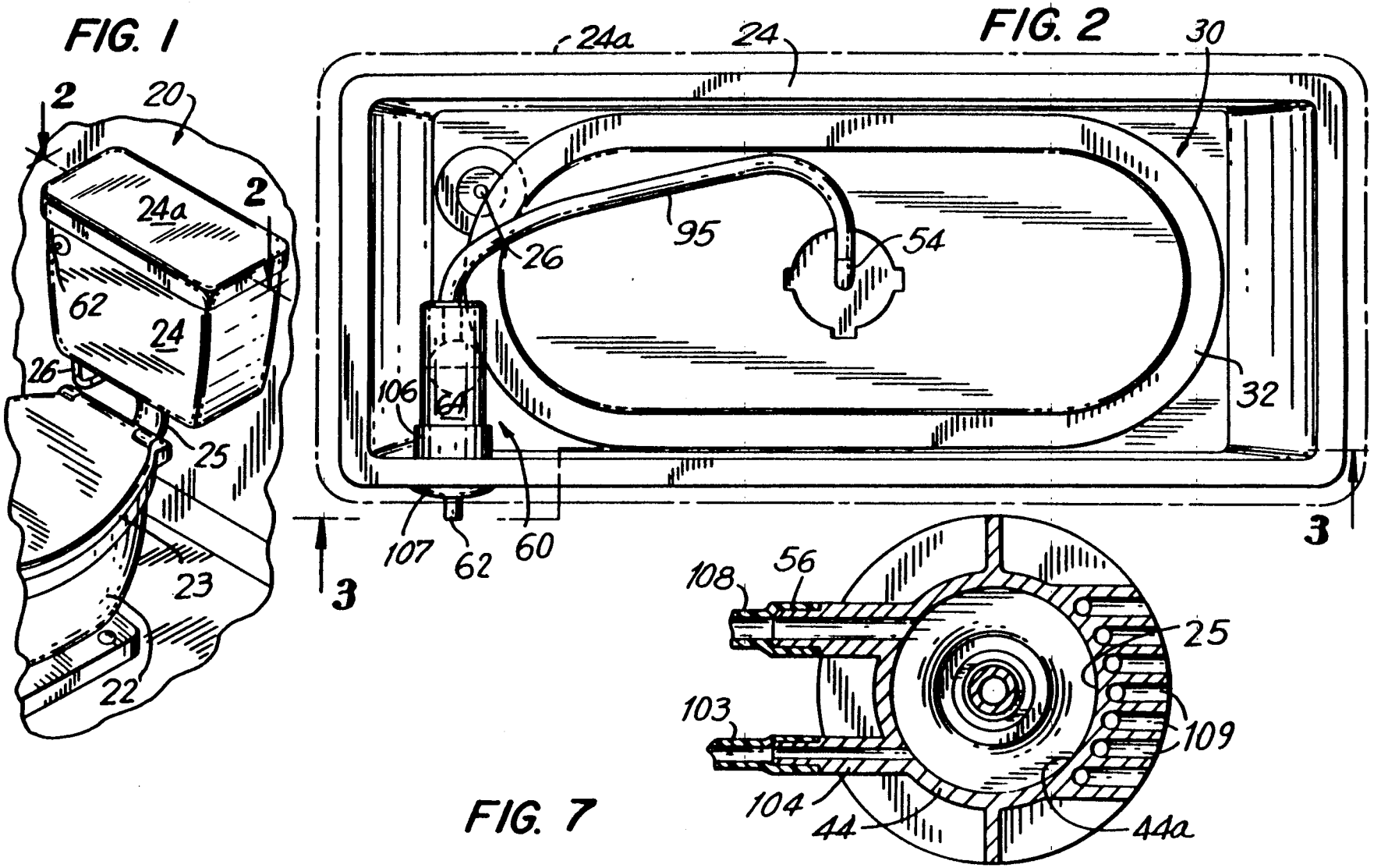
FIG. 1 is a partial perspective view of a conventional toilet incorporating an improved flushing mechanism and hydraulic actuation system constructed in accordance with the present invention.
FIG. 2 is an enlarged section view taken along line 2—2 of FIG. 1.
FIG. 7 is a sectional view taken along line 7—7 of FIG. 5.
Figure 3:
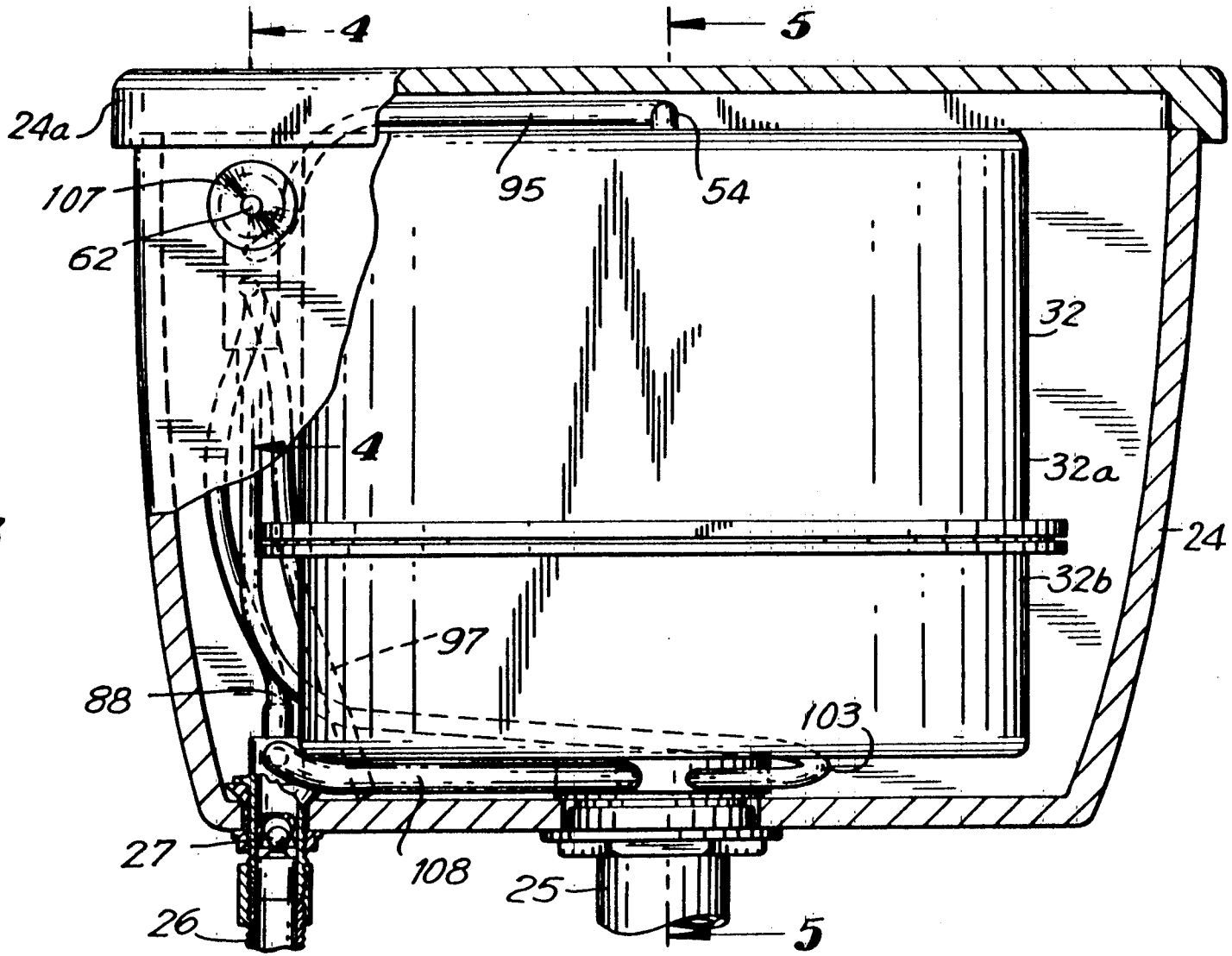
FIG. 3 is a sectional view taken along line 3—3 of FIG. 2.

Reference is first made to FIG. 1 which depicts a conventional toilet, generally indicated at 20, incorporating a flushing mechanism in accordance with the present invention. Toilet 20 includes a toilet bowl 22 having a toilet seat and cover 23 pivotably coupled thereto and a tank 24 with a removable cover 24*a* coupled to bowl 22 through a drain line 25. Fresh water is provided to tank 24 at main pressure through water supply line 26.

In a conventional toilet such as toilet 20 depicted in FIG. 1, tank 24 is adapted to hold between about 14 to 16 liters of water which amount of water is required to flush bowl 22 of waste material and replenish same with fresh water during each flushing operation. The flushing mechanism of the present invention utilizes a conventional toilet 20 but provides an internal system to be placed in tank 20 after the old components are removed to permit substantially less water (about $4\frac{1}{4}$ to 6 liters) to be utilized during each flushing operation.

Reference is now made additionally to FIGS. 2 through 7 for use in explaining a first embodiment of a flushing mechanism, generally indicated at 30, constructed in accordance with a first embodiment of the present invention Flushing mechanism 30 includes a containment or storage vessel 32 adapted to hold between about $4\frac{1}{4}$ and 6 liters of water or other liquid, and a hydraulic actuation system, generally indicated at 60. Actuation system 60 includes an actuator button 62.

Figure 5:
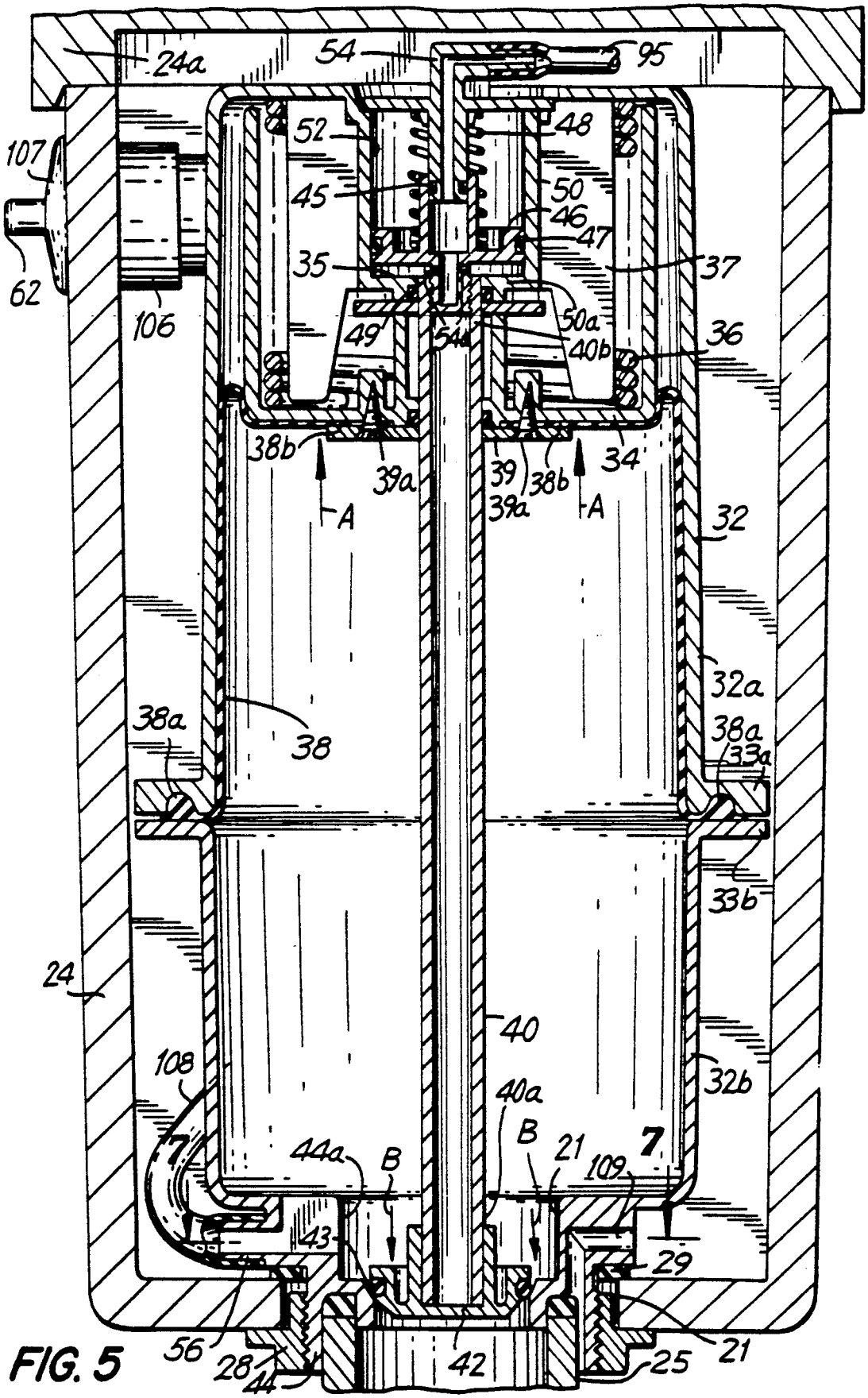
FIG. 5 is an enlarged sectional view taken along line 5—5 of FIG. 3.

Referring specifically to FIG. 5, it is seen that containment vessel 32 is an enclosed elliptical chamber (cylindrical in cross section) defined by a first section 32*a* and a second section 32*b* which are joined together at flanges 33*a* and 33*b*. A piston 34 is biased within containment vessel 32 by means of a mechanical compression piston spring 36. Piston spring 36 is supported around a supporting member 37. A rolling diaphragm 38 includes a first end 38*a* which is captured between flanges 33*a* and 33*b* and a second end 38*b* which is held to piston 34 by means of a plate 39 and appropriate fastening means such as screws 39*a*.

A flush valve body 44 is defined at the bottom of containment vessel 32 and includes a central opening 44*a* therethrough. Containment vessel 32 is held to tank 24 through an opening 21 therein by means of a threaded nut 28 secured to flush valve body 44. A gasket 29 may be used to prevent leaks. Containment vessel 32 is sized to fit in a standard—sized toilet tank of about 14 liters.

A flush valve stem 40 extends along a central portion of containment vessel 32 and includes a first end 40*a* and a second end 40*b*. A flush valve 42 is coupled to first end 40*a* of flush valve stem 40 and includes a flush valve seal ring 43 which releasably seals flush valve 42 against flush valve body 44 to prevent water or other liquid within containment vessel 32 from escaping through drain line 25 until flushing is actuated, as described below in detail.

A flush valve plate 46 is coupled to second end 40*b* of flush valve stem 40. Flush valve plate 46 is normally biased in a lower position as depicted in FIG. 5 by means of flush valve spring 48. Flush valve plate 46 includes a second flush valve seal ring 47 which seals flush valve plate 46 against a wall 50 which defines a closed flush valve initiation chamber 52. A third seal ring 45 and a fourth seal ring 49 are also provided to prevent leaking.

A flush valve fitting 54 extends into initiation chamber 52 to permit water provided by flush actuation system 60 to fill flush initiation chamber 52 as described below in detail. Containment vessel 32 also includes a refill valve fitting 56 at the bottom thereof to permit water or other liquid under main supply pressure to refill containment vessel 32 as also described below in detail. The system may include a pressure regulator to reduce the water supply pressure, if necessary.

When flush valve 42 is closed to seal off containment vessel 32 from drain line 25, and water fills containment vessel 32, piston 34 will be forced in an upward direction in the direction of arrows A against the force of piston spring 36 to compress same. The water within containment vessel 32 will also act to assist in forcing flush valve seat 42 in a downward direction as shown by arrows B. In addition, it is noted that flush valve plate 46 is in its lower position and defines a small gap 35 with bottom wall 50*a* of initiation chamber 52 (FIG. 5).

Figure 4:
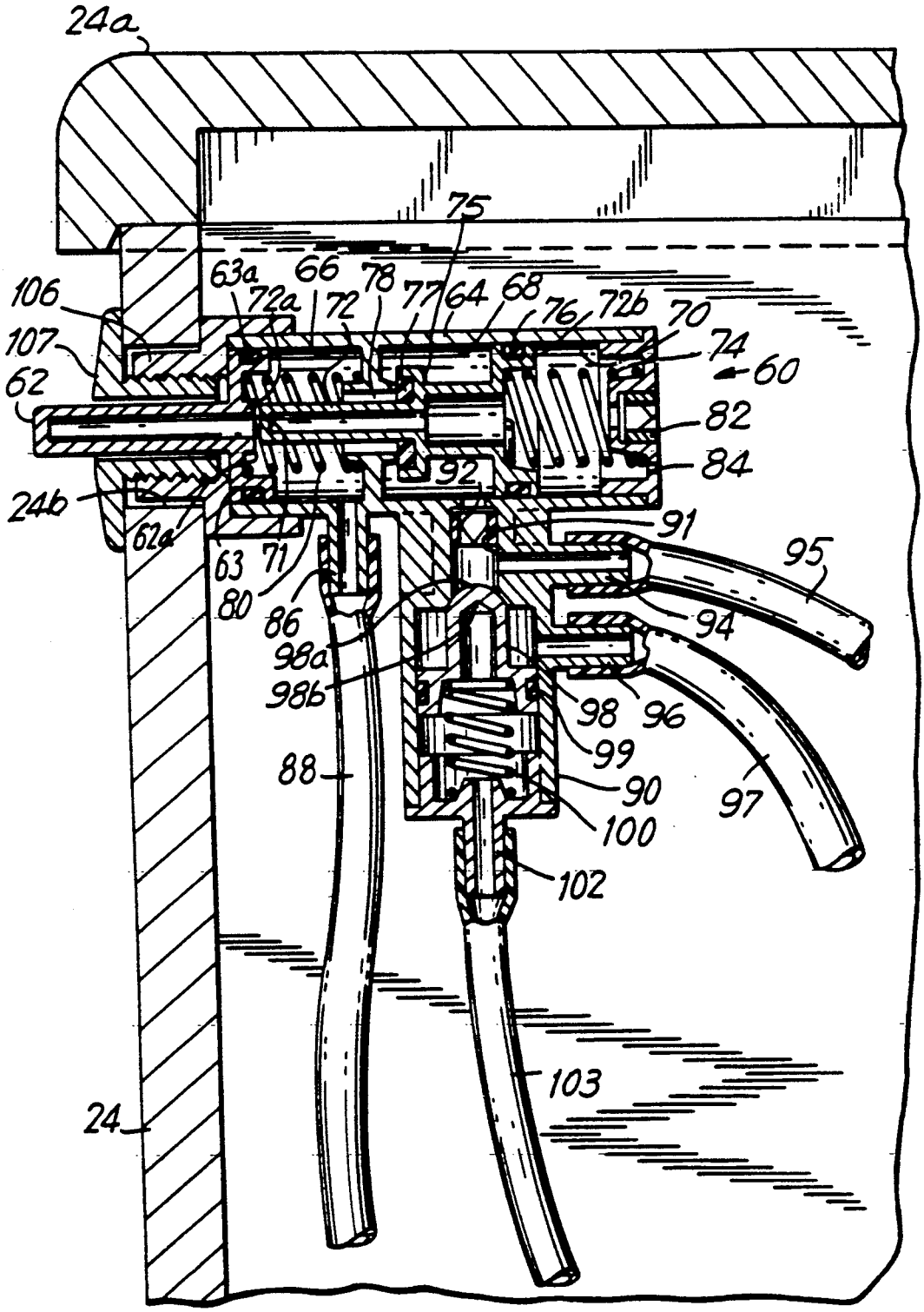
FIG. 4 is an enlarged sectional view taken along line 4—4 of FIG. 3.

Reference is now made to FIG. 4 which depicts hydraulic actuation system 60 in detail. Actuation system 60 includes an actuator valve body 64 defining an actuator valve chamber 66, a reseal valve chamber 68 and a reseal timing chamber 70. Actuator button 62 terminates in an actuator plate 63 which includes a sealing ring 63*a* which seals actuator plate 63 against the interior wall defining actuator valve chamber 66 A reseal valve stem 72 includes a first end 72*a* which is normally spaced by a small gap 71 from first end 62*a* of actuator button 62 under the force of reseal valve return spring 74 and an enlarged second end 72*b* which includes a sealing ring 76 which rides against the interior surface defining reseal timing chamber 70. Reseal valve stem 72 also includes an interior plate 75 which includes a sealing washer 77 which presses against an interior shoulder 78 when reseal valve stem 72 is in the position depicted in FIG. 4.

An actuator button return spring 80 normally biases actuator button 62 in an outward direction. Actuator valve body 64 includes a reseal timing check valve 82 and reseal timing orifice 84. Actuator valve body 64 also includes an actuator supply line fitting 86 which is coupled through an actuator supply line 88 to water supply line 26 (FIG. 3) which supplies water under pressure to actuator supply line 88.

Actuator valve body 64 includes an extension 90 which includes an interior section 91 which is opened to reseal valve chamber 68 through a drain line check valve 92. Extension 90 includes a flush actuation fitting 94 which is coupled by a flush actuation line 95 to flush valve fitting 54 on containment vessel 32 (FIG. 2). Extension 90 also includes an actuator drain fitting 96 which may include an actuator drain line 97.

Interior section 91 of extension 90 also includes a drain line valve 98 having a sealing ring 99 which is normally biased in an upward position by means of a drain line valve return spring 100. A pressure feedback fitting 102 is coupled to a second pressure feedback line 103 (FIG. 7).

It is noted that flush actuator system 60 is held to tank 24 through an opening 24*b* conventionally found in toilet 20. A nut 106 is fastened to a face plate 107 to affix the system to the tank. It is also noted that a water supply line 26 to fill containment vessel 32. Water supply line 26 should include a check valve 27 to prevent dirty waste water from entering the fresh water line. Finally, it is noted that flush valve body 44 includes a plurality of drain line openings 109 which drain any water in tank 24 outside of containment vessel 32 into bowl 22.

Reference is now made to FIGS. 2 through 7 to provide an explanation of the operation of flushing mechanism 30 and hydraulic actuation systems 60. As shown in FIG. 5, before the flush cycle begins, the system is at rest with containment vessel 32 filled with water, piston 34 in its uppermost position and piston spring 36 compressed. All valves are closed and no water is flowing through the system.

The flush cycle is started by depressing actuator button 62. This action opens reseal valve stem 72 allowing water at system supply pressure in actuator supply line 88 and actuator valve chamber 66 to flow through shoulder 78 into reseal valve chamber 68, through check valve 92 and through fitting 94 into flush actuation line 95. Water under pressure in line 95 flows into fitting 54, through openings 54*a* and into gap 35 in initiation chamber 52 thereby pressurizing the initiation chamber to system supply pressure.

Figure 6:
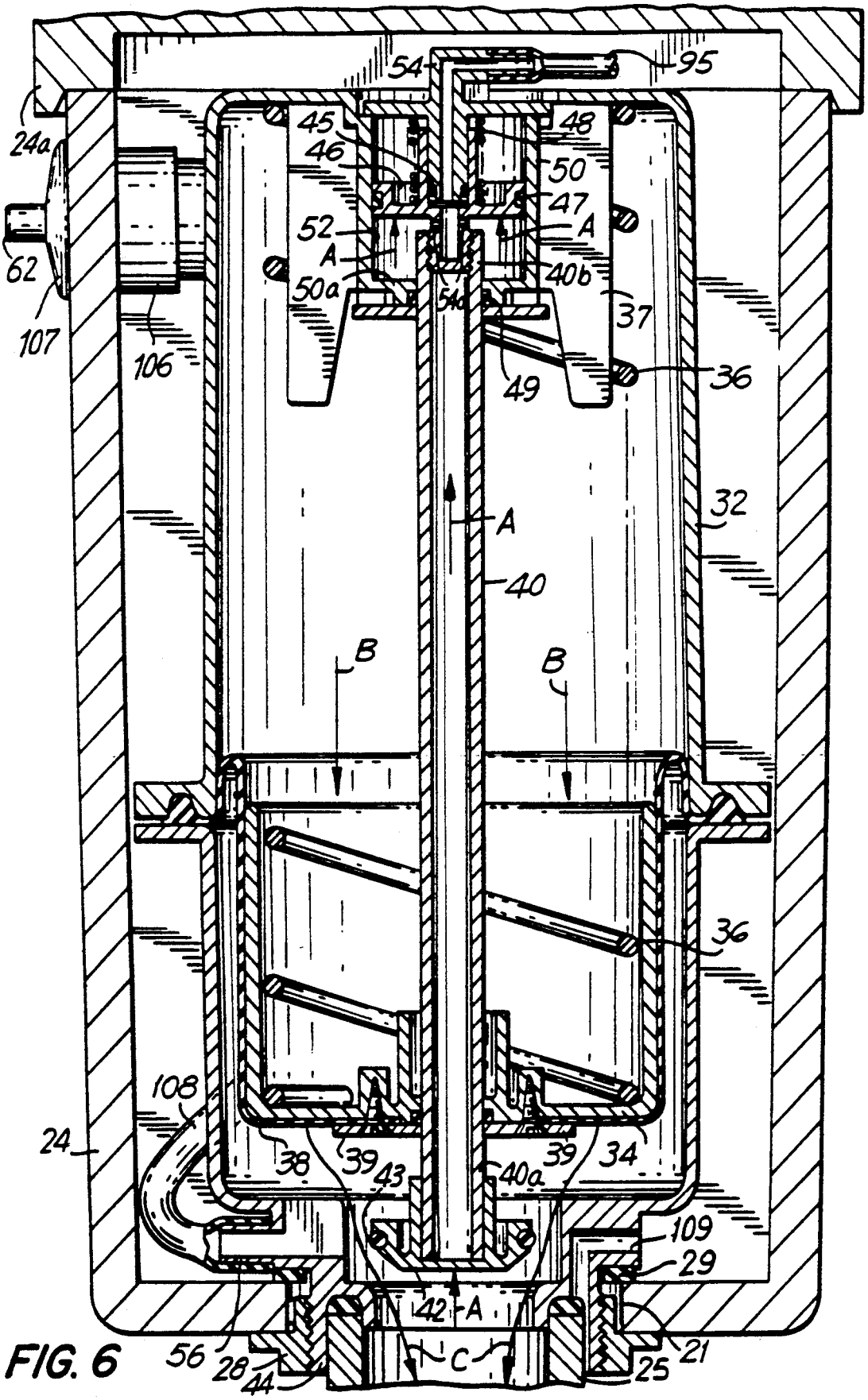
FIG. 6 is a sectional view similar to FIG. 5 but showing the flushing mechanism after the toilet has been flushed.

This water pressure acts against flush valve plate 46 and produces a force which compresses flush valve spring 48 thereby moving flush valve stem 40 upward in the direction of arrow A releasing flush valve 42 from flush valve body 44 as best depicted in FIG. 6. The travel of flush valve plate 46 and hence flush valve stem 40 and flush valve seat 42 is limited to a predetermined compression of spring 48.

When actuator button 62 is released, system supply pressure provided through line 88 acts to restore button 62 to its original position. Spring 80 assists in assuring return of the actuator button especially in an unpressurized system.

When drain line 25 is open to the interior of containment vessel 32 as depicted in FIG. 6, water in the containment vessel will flow rapidly in the direction of arrows C into drain line 25 and hence into toilet bowl 22 under the added pressure exerted by piston 34 on the water under the action of spring 36 as it releases its energy when it relaxes. This action substantially increases the pressure of the water flowing into the toilet bowl thereby providing a superior flush and requiring substantially less water during each flushing operation. In fact it has been found that only about 4¼ to 6 liters of water (as opposed to 14 to 16 liters required in conventional tanks) is all that is required in the present invention to provide complete flushing action.

Rolling diaphragm 38 acts to prevent water in containment vessel 32 from flowing beyond piston 34 and to prevent contact of the water with piston spring 36. However, it is noted that other types of piston isolation means such as a sliding seal, could be utilized. It is also noted that although a compression spring 36 is depicted, an extension spring could also be utilized in a reverse configuration.

While actuator button 62 will immediately return to its original position when released, it is desirable to delay closure of reseal valve stem 72 to insure complete opening and drainage of the flush valve system. Such delay is accomplished in the present invention by a reseal timing system. In particular, at the start of the flushing cycle, depressing of actuator button 62 drives reseal valve stem 72 open, thereby expelling air through reseal timing check valve 82. Return of reseal valve stem 72 to its original position is slowed by the resulting vacuum created in reseal timing chamber 70 The rate at which reseal valve stem 72 is reset is controlled by the rate of flow of air back into reseal timing chamber 70 through reseal timing orifice 84.

In the present embodiment, resealing of flush valve 42 to close off drain 25 is triggered by the decay in pressure inside containment vessel 32 near the end of the flush cycle. When reseal valve stem 72 closes, the pressure in flush actuation line 95 drops below system supply pressure. Since water in flush actuation line 95 and flush initiation chamber 52 represents a closed system, its pressure level is set by the force of flush valve spring 48. This pressure serves as a reference pressure on the upper surface 98*a* of drain line valve seal 98.

The pressure in pressure feedback line 103, acting against the lower surface 98*b* of drain line valve seal is compared to that reference pressure When pressure within containment vessel 32 drops to a level such that the force from the reference pressure acting against top 98*a* of drain line valve 98 is sufficient to overcome the sum of the forces from the friction created by sealing ring 99, drain line valve return spring 100 and pressure acting against lower surface 98*b* of drain valve 98 from pressure feedback line 103, drain line valve 98 will open. Opening of drain line valve 98 allows flush valve spring 48 to move flush valve stem 40 in a downward direction and hence causes flush valve seat 42 to seat against flush valve body 44 to close off drain line 25. Accordingly, the system acts as a pressure sensing system to sense the end of the flush cycle to close off the flush valve while insuring that the flush valve stays open until flushing is complete. This also acts to conserve water.

A portion of the water in flush actuation line 95 displaced by the travel if flush valve plate 46 passes through drain line 97 into tank 24. When water in tank 24 reaches a depth above the height of drain 109 in valve body 44, excess water flows through drain 109 into toilet bowl 22.

When the flush valve is closed, water under system pressure from supply line 108 will refill containment vessel 32 thereby moving piston 34 in the direction of arrow A and compressing spring 36 to the condition depicted in FIG. 5. The system is then ready to be reflushed when necessary.

Figure 8:
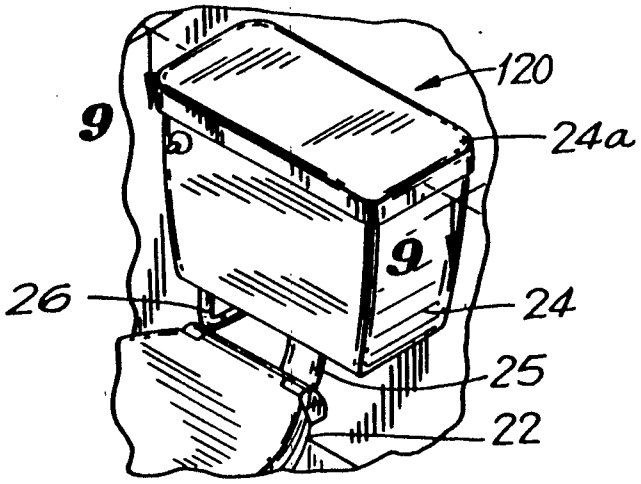
FIG. 8 is a partial perspective view of a conventional toilet incorporating an improved flushing mechanism constructed in accordance with a second embodiment of the present invention.
Figure 9:
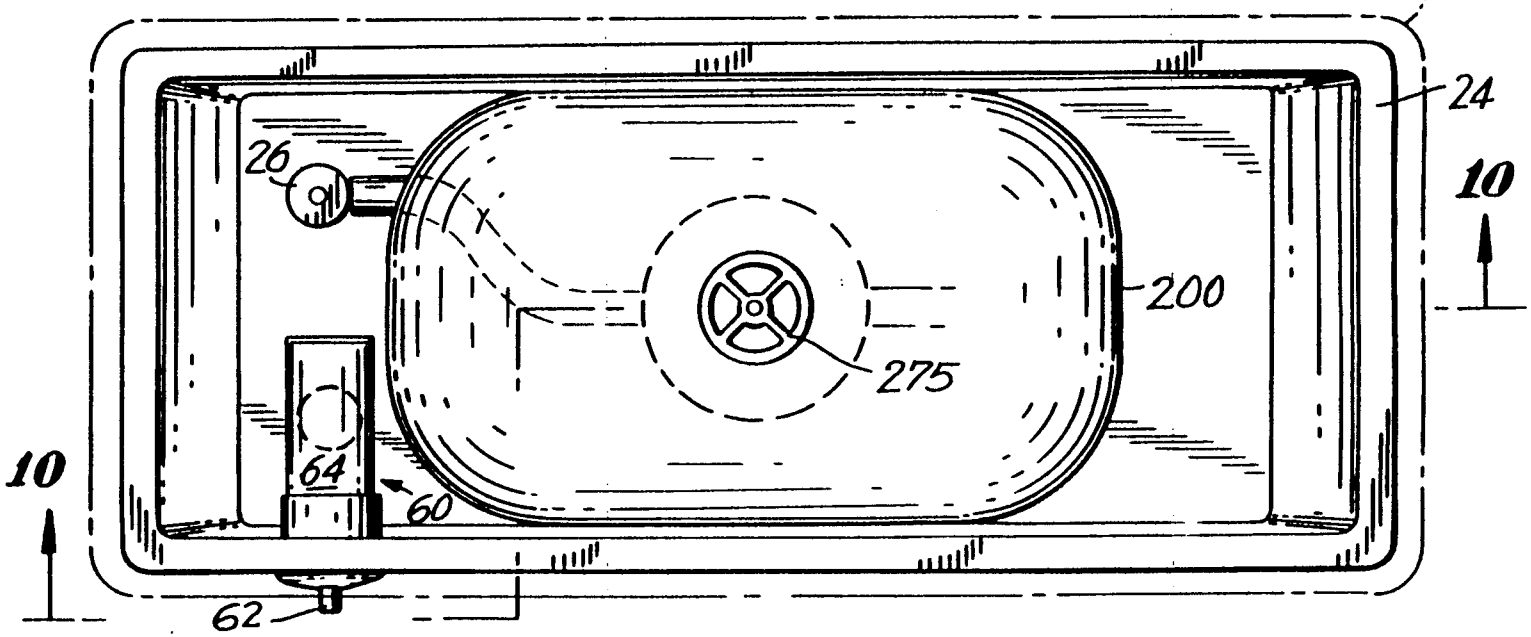
FIG. 9 is an enlarged sectional view taken along line 9—9 of FIG. 8.

Reference is now made to FIGS. 8 through 12 for the purpose of describing a second embodiment of the present invention Like elements in FIGS. 8 through 12 to those shown in FIGS. 1 through 7 are numbered alike Referring to FIG. 8, a conventional toilet generally indicated at 20 having a toilet bowl 22 and a tank 24 coupled thereto through a drain line 25 is depicted. Water supply line 26 supplies water under main system pressure to tank 24 as described herein. Tank 24 also includes a removable cover 24*a*. Referring to FIG. 9, it is seen that a containment vessel 200 sized to fit within tank 24 and adapted to hold about 6 liters of water or other liquid is provided. Hydraulic actuation system 60 is constructed similarly to actuation system 60 depicted in FIGS. 1 through 7.

Figure 10:
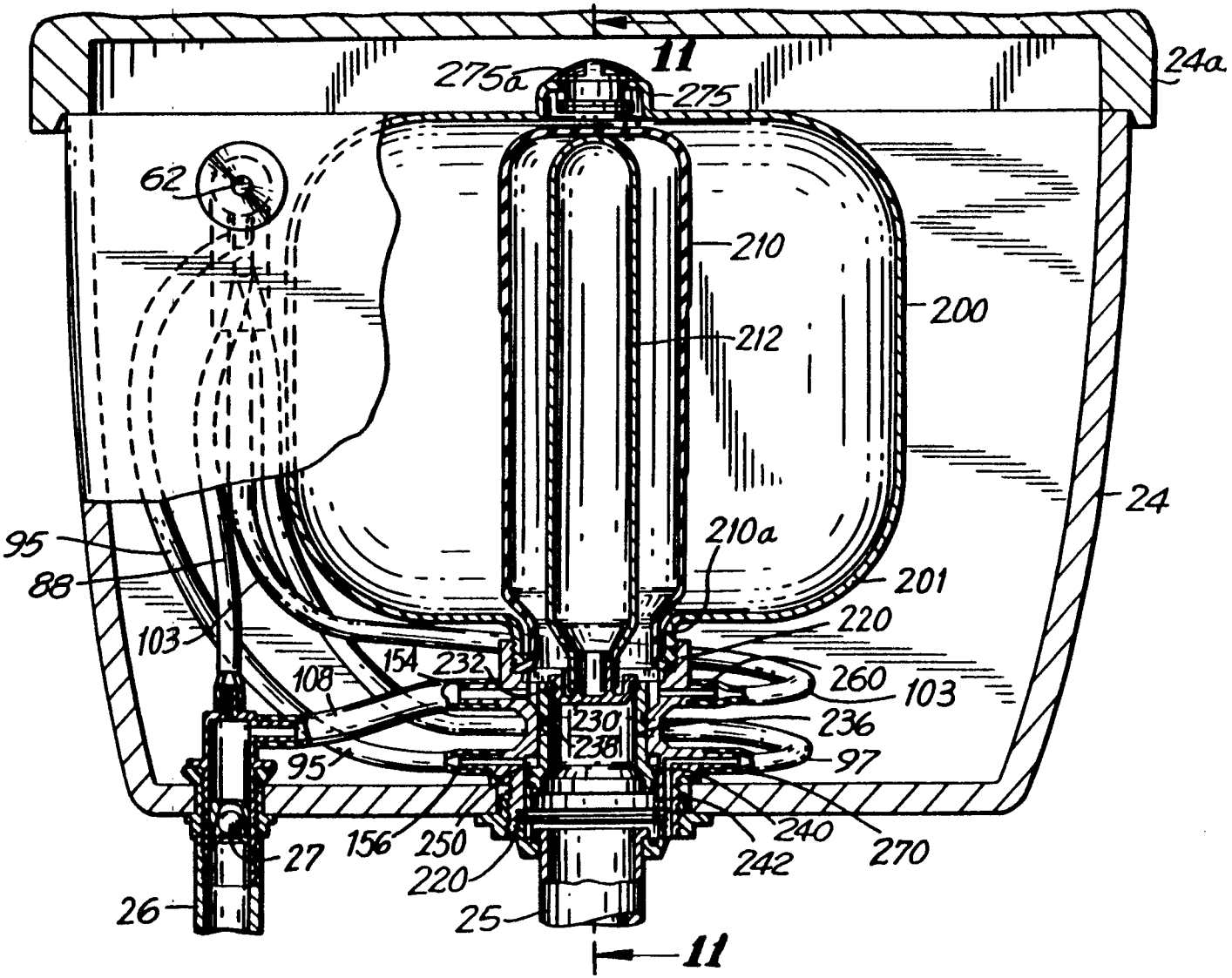
FIG. 10 is a sectional view taken along line 10—10 of FIG. 9; p
Figure 11:
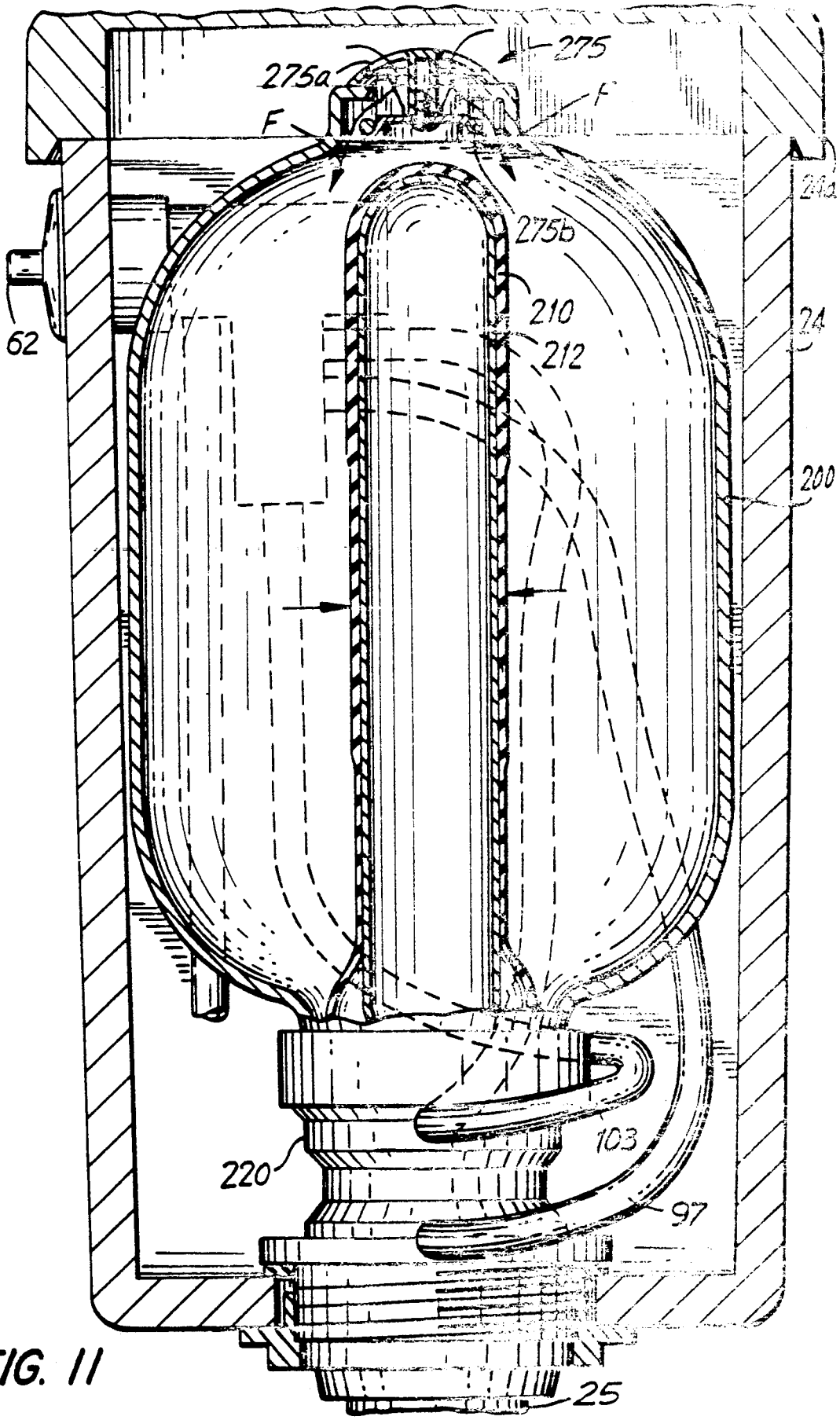
FIG. 11 is an enlarged sectional view taken along line 11—11 of Fig. 10.
Figure 12:
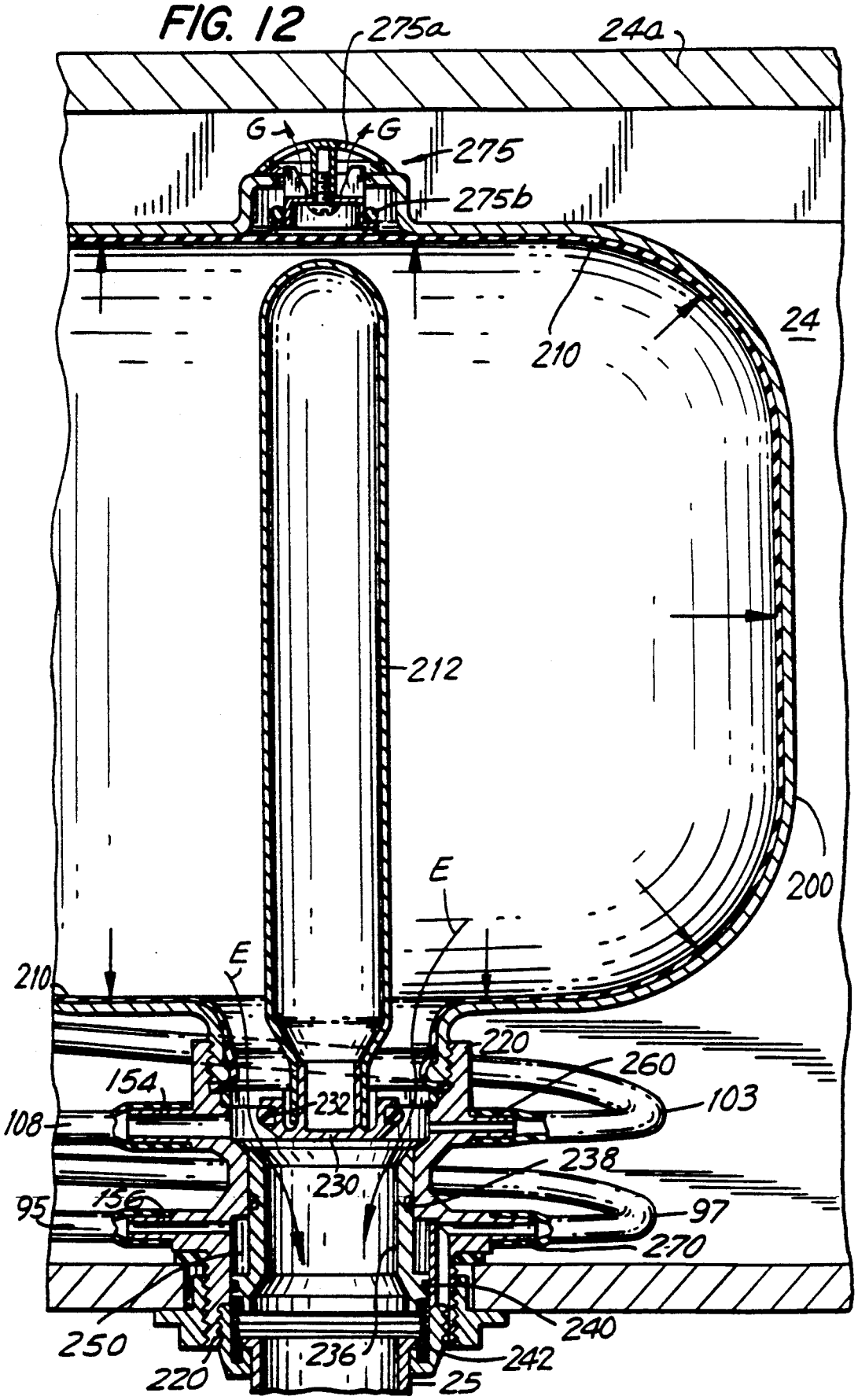
FIG. 12 is an enlarged partial sectional view similar to FIG. 10 but showing an elastic bladder in its expanded and filled condition.

Referring specifically to FIGS. 10 through 12, it is seen that instead of the spring biased piston system depicted in FIGS. 1 through 7, the second embodiment of the present invention utilizes an elastic bladder system to increase water flushing pressure. In this regard, containment vessel 200, also sized to fit in a standard toilet tank of about 14 liter size, includes an internal elastic bladder 21O which, when deflated, is supported by a bladder support tube 212. Bladder 210 is constructed from an appropriate stretchable material such as rubber, the open end 210*a* of which is captured intermediate a wall 201 defining containment vessel 200 and flush valve body 220. In a preferred embodiment, the elastic bladder is made from an EDPM material and is sized to expand about two to four times its unstretched size.

A flush valve seat 230 is fitted on the end of bladder support tube 212 and includes a sealing ring 232 therearound. A displaceable flush valve 236 includes a first sealing ring 238 and a second sealing ring 40. A flush initiation chamber 250 is defined intermediate flush valve 236 and flush valve body 220. Flush valve 236 is normally biased against flush valve seat 230 through the action of a flush valve spring 42 thereby closing off the interior of bladder 210 to drain line 25. Flush valve body 220 includes a refill valve fitting 154 coupled to water supply line 108 and a flush valve fitting 156 coupled to flush actuation line 95. Flush initiation chamber 250 receives water under pressure from flush actuation line 95. Flush valve body 220 also includes a pressure feedback fitting 260 coupled to pressure feedback line 103, and a drain fitting 270 coupled to actuator drain line 97.

In use, the hydraulic actuation system depicted in FIG. 4 and described above may be utilized to actuate the present embodiment Before the flush cycle is commenced, the system is at rest, with elastic bladder 210 filled with water (about 6 liters) and fully expanded to essentially fill containment vessel 200 as best depicted in FIG. 12 All Valves are closed.

The flush cycle is initiated as described above with reference to FIG. 4 by depressing actuator button 62 When actuator button 62 is depressed, flush actuation line 95 will be pressurized under the regular system pressure and will thereby pressurize flush initiation chamber 250 to system supply pressure. This pressure will produce a force to overcome the force exerted by flush valve spring 242 to move flush valve 236 in a downward direction away from flush valve seat 230 as best depicted in FIG. 12 thereby opening the interior of elastic bladder 210 to drain line 25. Water will be forced into drain line 25 around flush valve seat 230 as indicated by arrows E in FIG. 12. The normal pressure of the water due to gravity will be substantially enhanced by the force exerted by the compressing bladder 20. The force exerted by bladder 210 as it compresses permits substantially less water to be utilized to flush and replenish bowl 22 with water. As noted above, only about 6 liters of water are required for each flushing operation.

When the flushing operation is complete and flush valve seat 230 closes against flush valve body 236, water from water supply line 108 will enter through fitting 54 and refill bladder 210 with water. A containment vessel air make—up vent and overflow seal valve 275 at the top of containment vessel 200 includes a displaceable cap 275*a* which permits air to enter vessel 200 when cap 275*a* is in its lower rest position when bladder 210 is deflating as best depicted by arrows F in FIG. 11 as well as to permit air to escape when bladder 210 is inflating as shown by arrows G in FIG. 12. However, should bladder 210 burst or leak causing containment vessel 200 to fill with water, vent 275 will close when cap 275*a* rises and gasket 275*b* seals against containment vessel 200 as depicted in FIG. 12 to prevent the release of water from containment vessel 200. In addition, it is noted that the portion of the water in the flush actuator line 103 which is released on closing of the system flows through drain line 97 into drain fitting 270 and into toilet bowl 22.

It is noted that although the two flushing mechanism embodiments described above utilize hydraulic actuation, such is not required. For example, mechanical actuation of the flush cycle through a conventional system may be utilized. In addition, closing of the flush valve need not be based on feedback from containment vessel or bladder pressure, but could use a timing mechanism to control flow out of the flush initiation chamber, causing the flush valve to close slowly over a time interval longer than that required for the flush. It is also noted that the flushing mechanisms disclosed herein may be used to flush bowls or chambers other than toilet bowls.

Figure 13:
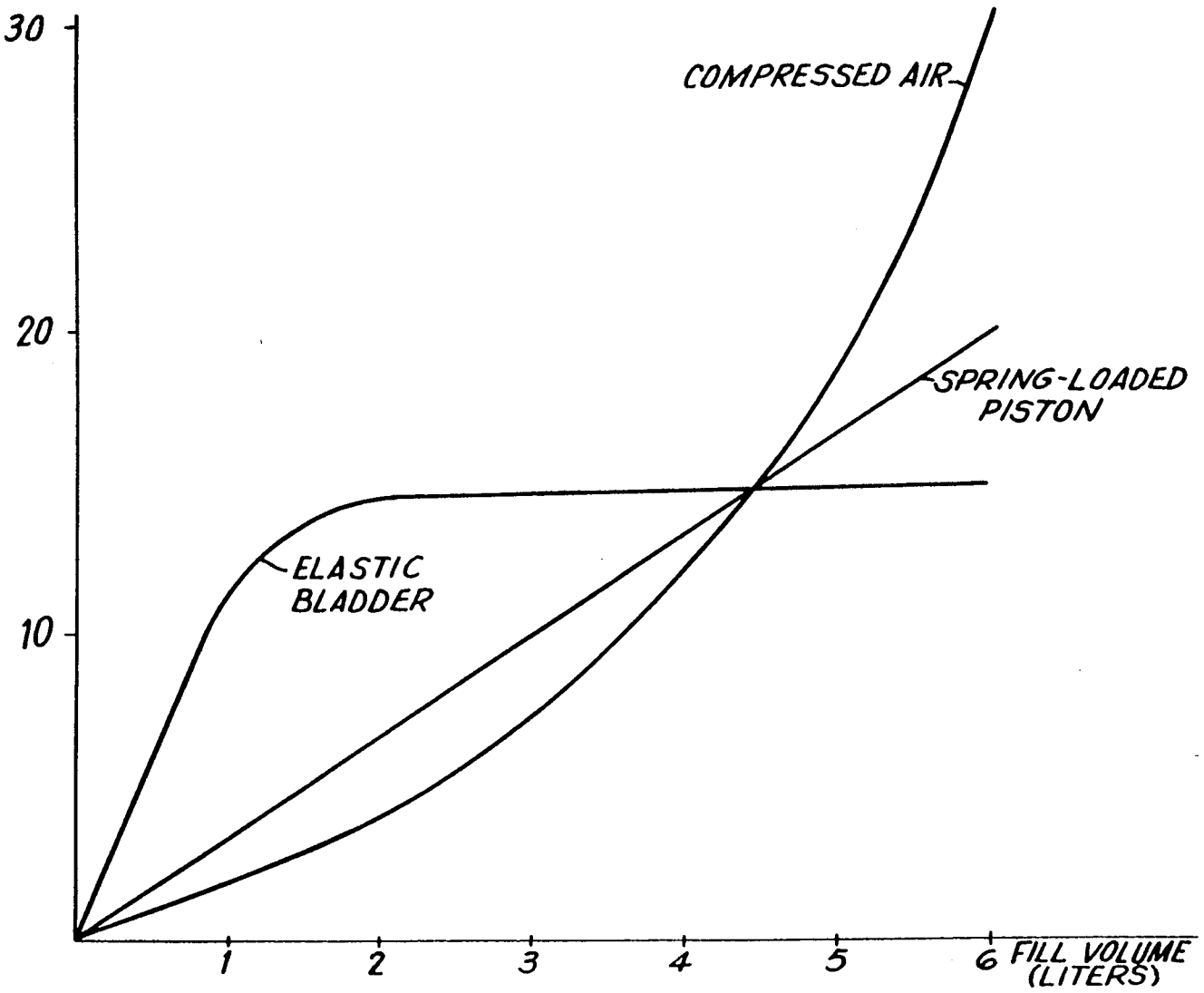
FIG. 13 is a graph showing fill volume verses pressure in several toilet flushing mechanisms.

Reference is now made to FIG. 13 which shoWs fill volume verses pressure for the two embodiments of the present invention as well as for a compressed air system according to the prior art. It is seen that the spring—loaded piston embodiment shows a constant rise in pressure as the spring is compressed with a pressure of about 20 psi at 6 liter fill volume. The elastic bladder embodiment shows a rapid rise in pressure as it first expands with a pressure of about 15 psi at 6 liter fill volume. The conventional compressed air system shows an exponential increase in pressure as the air is compressed with a pressure of about 30 psi at 6 liter fill volume. The prior art compressed air system therefore requires a larger tank than is required in the present invention.

The improved hydraulic actuation system disclosed herein insures proper operation and actuation of the flushing mechanisms while providing for water conservation.

In both of the above described flushing mechanism embodiments, a containment vessel adapted to fit in a conventional toilet tank is utilized with appropriate internal structure, such as the spring loaded piston system in the first embodiment and the elastic bladder system in the second embodiment, to increase pressure exerted by water flowing out of the tank and into the drain line such that significantly less water is required to flush and replenish the toilet bowl with water. The hydraulic actuation system can readily replace the pivotable handle found on conventional toilet tank. It is envisioned that replacement of the conventional toilet flushing mechanism with the present invention will be a relatively straightforward operation. The savings in cost to the consumer through reduced water usage during each flush cycle and the benefit to the public in general through water conservation is significant but readily achieved by the present invention.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A flushing mechanism for flushing a bowl with liquid comprising a containment vessel adapted to hold a predetermined amount of liquid, inlet means on said containment vessel for receiving said liquid under a predetermined pressure, outlet means on said containment vessel coupleable to said bowl for permitting said liquid when in said containment vessel to be released into said bowl, piston means displaceable in said containment vessel for forcing said liquid out of said containment vessel through said outlet means, biasing means for biasing said piston means against the force exerted by said liquid sealing means for releaseably sealing said outlet means, actuation means for releasing said sealing means to open said outlet means to permit said liquid in said containment vessel to be forced out of said containment vessel and into said bowl under the force of said piston means, said sealing means including a flush valve displaceable between a first position where said outlet means is closed to liquid in said containment vessel and a second position where said outlet means is open to liquid in said containment vessel, and pressure sensing means for determining when said liquid in said containment vessel has been substantially expelled and for closing said flush valve in response thereto.

2. The flushing mechanism as claimed in claim 1, wherein said biasing means is a spring coupled intermediate said piston means and said containment vessel.

3. The flushing mechanism as claimed in claim 1, wherein said containment vessel is sized to fit in a 14 liter toilet tank.

4. The flushing mechanism as claimed in claim 1, wherein said containment vessel is adapted to hold about 6 liters of water.

5. The flushing mechanism as claimed in claim 1, wherein said actuation means includes a manually displaceable actuator valve coupleable to a source of said liquid under pressure and displaceable between a first position where said pressurized liquid source is closed off to said flush valve and a second position where said pressurized liquid is provided to said sealing means to move said flush valve from its first to its second position.

6. The flushing mechanism as claimed in claim 5, wherein said sealing means defines an initiation chamber for receiving said liquid under pressure when said actuator valve is in its second position, a plate displaceable in said initiation chamber and coupled to said flush valve, said plate being displaceable in said initiation chamber when said liquid under pressure is introduced therein to move said flush valve from its first position to its second position.

7. The flushing mechanism as claimed in claim 6, wherein said sealing means includes a spring means for normally biasing said flush valve in its first position.

8. The flushing mechanism as claimed in claim 1, further comprising isolation means for isolating said biasing means from liquid when in said containment vessel.

9. The flushing mechanism as claimed in claim 8, wherein said isolation means is a rolling diaphragm coupled intermediate said piston means and said containment vessel to prevent said spring from contacting liquid when in said containment vessel.

10. A flushing mechanism for flushing a bowl with liquid comprising a containment vessel adapted to hold a predetermined amount of liquid, inlet means on said containment vessel for receiving said liquid under a predetermined pressure, outlet means on said containment vessel coupleable to said bowl for permitting said liquid when in said containment vessel to be released into said bowl, piston means displaceable in said containment vessel for forcing said liquid out of said containment vessel through said outlet means, biasing means for biasing said piston means against the force exerted by said liquid, sealing means for releaseably sealing said outlet means, actuation means for releasing said sealing means to open said outlet means to permit said liquid in said containment vessel to be forced out of said containment vessel and into said bowl under the force of said piston means, said sealing means including a flush valve displaceable between a first position where said outlet means is closed to liquid in said containment vessel and a second position where said outlet means is open to liquid in said containment vessel, said actuation means including a manually displaceable actuator valve coupleable to a source of said liquid under pressure and displaceable between a first position where said pressurized liquid source is closed off to said flush valve and a second position where said pressurized liquid is provided to said sealing means to move said flush valve from its first to its second position, said actuation means including timing means for slowly closing said actuator valve.

11. A flushing mechanism for flushing a bowl with liquid comprising a containment vessel adapted to hold a predetermined amount of liquid, inlet means on said containment vessel for receiving said liquid under a predetermined pressure, outlet means on said containment vessel coupleable to said bowl for permitting said liquid when in said containment vessel to be released into said bowl, piston means displaceable in said containment vessel for forcing said liquid out of said containment vessel through said outlet means, biasing means for biasing said piston means against the force exerted by said liquid, sealing means for releaseably sealing said outlet means, and actuation means for releasing said sealing means to open said outlet means to permit said liquid in said containment vessel to be forced out of said containment vessel and into said bowl under the force of said piston means, said sealing means including a flush valve displaceable between a first position where said outlet means is closed to liquid in said containment vessel and a second position where said outlet means is open to liquid in said containment vessel, said actuation means including a manually displaceable actuator valve coupleable to a source of said liquid under pressure and displaceable between a first position where said pressurized liquid source is closed off to said flush valve and a second position where said pressurized liquid is provided to said sealing means to move said flush valve from its first to its second position, said sealing means defining an initiation chamber for receiving said liquid under pressure when said actuator valve is in its second position, a plate displaceable in said initiation chamber and coupled to said flush valve, said plate being displaceable in said initiation chamber when said liquid under pressure is introduced therein to move said flush valve from its first position to its second position, and pressure sensing means for determining when said liquid in said containment vessel has been substantially expelled and for closing said flush valve in response thereto.

12. The flushing mechanism as claimed in claim 11, wherein said pressure sensing means includes a drain line valve displaceable between a first position where said initiation chamber receives said liquid under pressure and a second position where liquid under pressure in said initiation chamber is released.

13. The flushing mechanism as claimed in claim 12, further including biasing means for normally biasing said drain line valve in its first position.

14. The flushing mechanism as claimed in claim 13, wherein said drain line valve includes a first opening coupled to said outlet means for sensing the flow of said liquid in said flush valve and a second opening to permit said initiation chamber to drain when said drain line valve is in its second position.

* * * * *